United States Patent [19]

Tawil

[11] Patent Number: 4,735,067

[45] Date of Patent: Apr. 5, 1988

[54] GUARD MEMBER FOR PREVENTING TAMPERING WITH COMBINATION LOCKS

[76] Inventor: Abraham I. Tawil, 2334 Ocean Pkwy., Brooklyn, N.Y. 11223

[21] Appl. No.: 41,113

[22] Filed: Apr. 22, 1987

[51] Int. Cl.[4] ..... E05B 37/02; E05B 17/00

[52] U.S. Cl. ..... 70/312; 70/431; 70/442

[58] Field of Search ..... 70/312, 315–319, 70/333 R, 416, 417, 420, 431, 442, 444, 445, 67–76; 292/288

[56] References Cited

U.S. PATENT DOCUMENTS

| | | | |
|---|---|---|---|
| 3,416,338 | 12/1968 | Gehrie | 70/312 |
| 4,123,923 | 11/1978 | Bako | 70/74 |
| 4,279,137 | 7/1981 | Cook | 70/416 |
| 4,354,367 | 10/1982 | Wahl | 70/333 A |
| 4,383,425 | 5/1983 | Orabona | 70/312 |

*Primary Examiner*—Robert L. Wolfe
*Assistant Examiner*—Suzanne L. Dino
*Attorney, Agent, or Firm*—Ezra Sutton

[57] ABSTRACT

A guard member for combination locks is provided which is situated under the actuating button to prevent it from being moved to the left or right to reset the combination until the guard member is removed.

9 Claims, 4 Drawing Sheets

GUARD MEMBER FOR PREVENTING TAMPERING WITH COMBINATION LOCKS

FIELD OF THE INVENTION

This invention relates to apparatus for preventing a combination on a combination lock from being set or reset, unless said apparatus is first removed from said combination lock in order to discourage vandalism.

BACKGROUND OF THE INVENTION

Combination locks, particularly as used on attache cases, have means for setting and resetting the combination. such locks typically include an actuating button connected to a stem which is connected to a slide member inside the lock. When the button is moved in the direction of the combination wheels, the combination numbers can be set or reset by rotating the wheels to the desired numbers, in a known manner. However, if the combination is preset before the attache case is purchased, then unless the purchaser knows the combination which has been previously set, the combination cannot be reset. Thus, it is important to provide means on the combination lock to prevent the combination from being set prior to purchase whether inadvertently or intentionally, since in most cases, it renders the attache cases unsaleable and results in costly returns by the retailer to the manufacturer.

Broadly, it is an object of the present invention to provide an improved guard member for preventing a combination on a combination lock from being set or reset, unless the guard member is first removed from the combination lock.

Broadly, it is also an object of the present invention to provide an improved guard member which overcomes the drawbacks of the prior art, which is simple to use, economical to manufacture, and is effective in preventing tampering with combination locks and vandalism.

Briefly, in accordance with the principals of the present invention, there is provided an improved guard member for use on a combination lock for preventing the combination wheels from being set or reset, which includes a flat locking member having an interior opening for receiving the stem connecting the actuating button to the inner lock mechanism. The locking member is seated under the button and on the cover plate for the lock during manufacture. In addition, the locking member either completely or substantially surrounds the interior opening, and the interior opening is of a size smaller than the actuating button in order to prevent the locking member from being slipped over the actuating button and removed from the lock. In the preferred embodiment, the locking member is provided with a blocking leg disposed between the actuating button and the combination wheels and is of a size to prevent the button from being moved toward or away from said combination wheels to reset the combination.

In the preferred embodiment, the blocking leg includes a first abutment having a straight edge (or other shape) for engaging the stem under the actuating button, and a second abutment having a straight edge (or other shape) for engaging the combination wheel closest to the actuating button.

Advantageously, as a result of the present invention, an improved guard member is provided for preventing the combination wheels from being inadvertently or intentionally reset, unless the guard member is first removed from the combination lock.

Further objects, features, and advantages of the present invention will become apparent upon the consideration of the detailed description of the preferred embodiments when taken in conjunction with the accompanying drawings.

DESCRIPTION OF THE PRIOR ART

Figure 1:
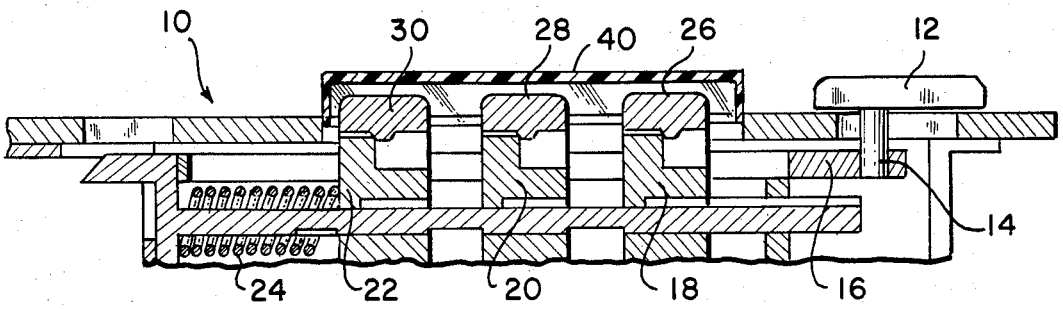
FIG. 1 PRIOR ART
FIG. 1 is a cross-sectional view of a combination lock showing use of a prior art tab.
Figure 2:
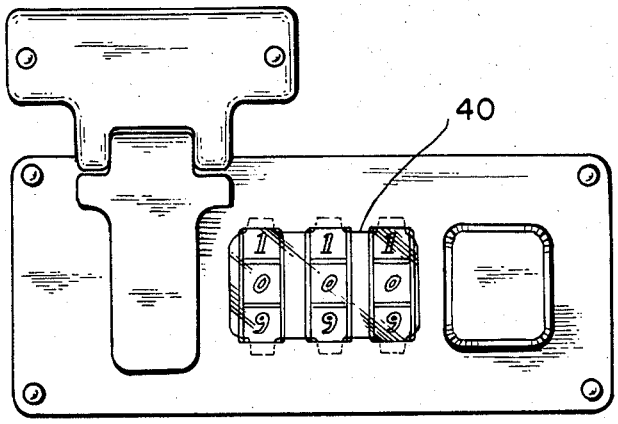
FIG. 2 PRIOR ART
FIG. 2 is a top plan view of the combination lock of FIG. 1.

FIG. 1 shows a typical combination lock of the type having the feature wherein the combination may be reset and is designated by reference numeral 10. The lock includes an actuating button 12 connected to a stem 14 which is connected to a slide member 16 which engages and operates to move internal sleeves 18, 20, and 22 against a spring 24. In this manner, the sleeves 18, 20, and 22 are moved out of operative engagement with the surrounding combination dials 26, 28, and 30, so that these dials may be moved to reset the combination, in a known manner.

Figure 3:
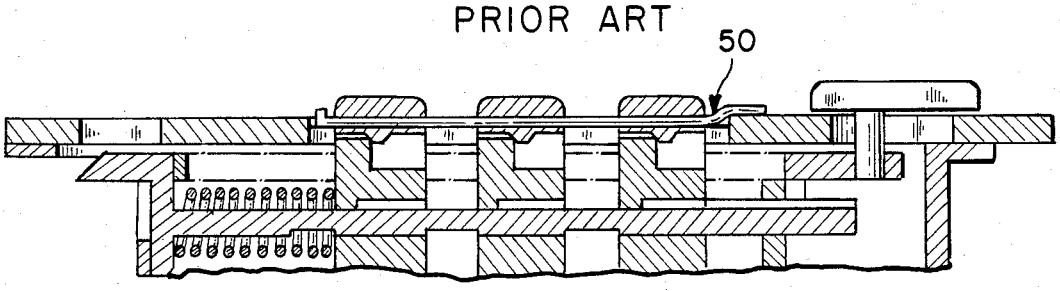
FIG. 3 PRIOR ART
FIG. 3 is a cross-sectional view of a combination lock showing the use of a different prior art arrangement.

FIGS. 1 and 3 illustrate an embodiment in the prior art employing a transparent acetate tab 40 which covers the combination wheels 26, 28, and 30 and is intended to discourage setting or resetting of the combination. However, such a prior art arrangement is easy to avoid by simply removing the tab manually, which then allows the dials to be rotated and the combination reset. Thus, such an arrangement has not been satisfactory.

Figure 4:
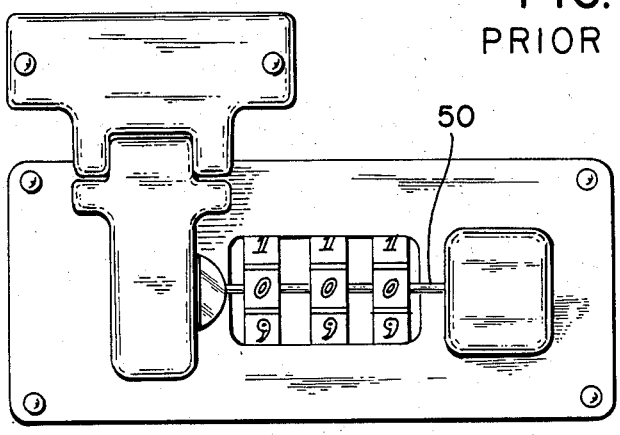
FIG. 4 PRIOR ART
FIG. 4 is a top plan view of the combination lock of FIG. 3.

FIGS. 3 and 4 illustrate another embodiment in the prior art which employs inserting an elongated member 50 through aligned holes in the circumferences in the three combination dials 26, 28, and 30. Elongated member 50 prevents the random rotation of the dials, thereby discouraging tampering. However, elongated member 50 may be too easily removed manually and thus has not been satisfactory in discouraging tampering and/or resetting of the combination.

Figure 5:
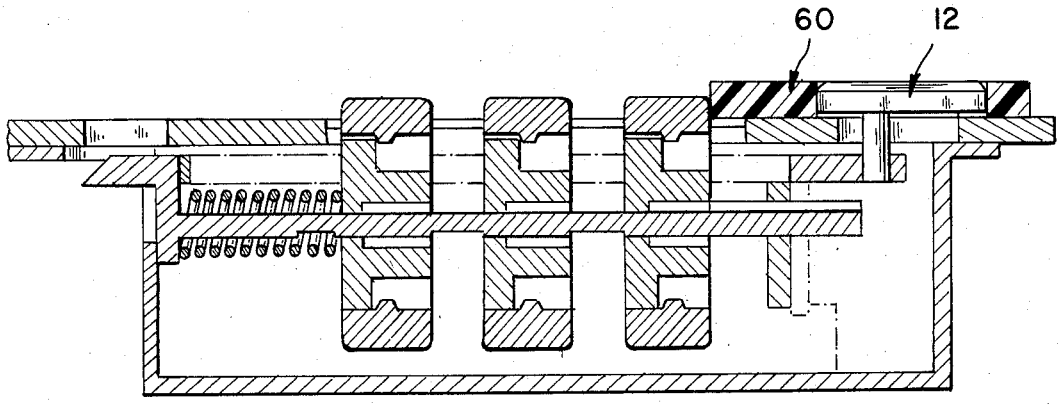
FIG. 5 PRIOR ART
FIG. 5 is a cross-sectional view of a combination lock showing still another prior art arrangement.
Figure 6:
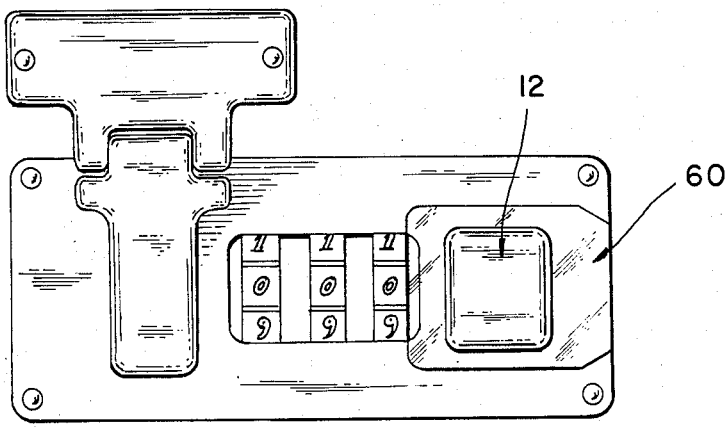
FIG. 6 PRIOR ART
FIG. 6 is a top plan view of the combination lock of FIG. 5.

FIGS. 5 and 6 show still another prior art arrangement which employs an exterior-mounted sleeve or collar 60 which is placed over the actuating button 12 and surrounds the button (but does not extend under it) to prevent it from being moved in the direction of the combination dials, and thus prevents the combination from being reset. Since the collar 60 may be simply lifted off of the actuating button 12, this arrangement has not been effective in preventing tampering with the combination and resetting the combination.

DESCRIPTION OF THE PRESENT INVENTION

Figure 7:
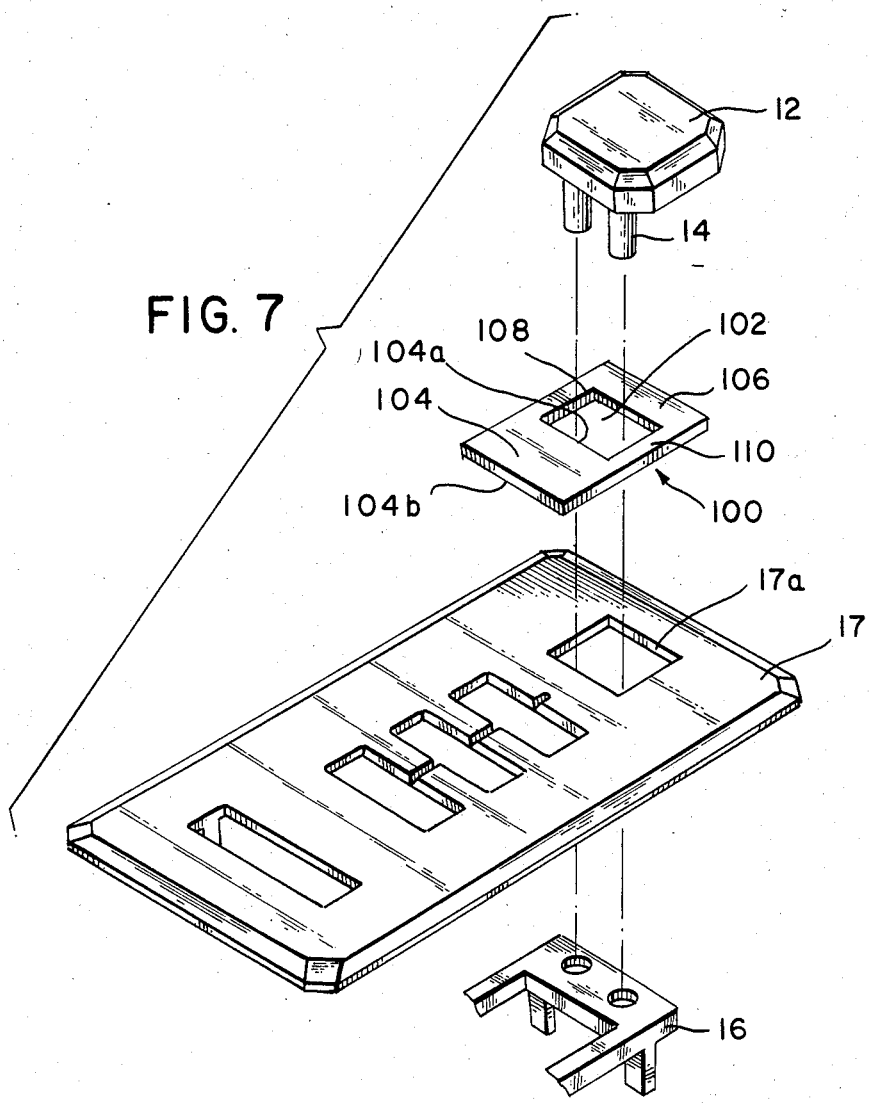
FIG. 7 is an exploded perspective view of the present invention showing the guard member in relationship to the combination lock.
Figure 8:
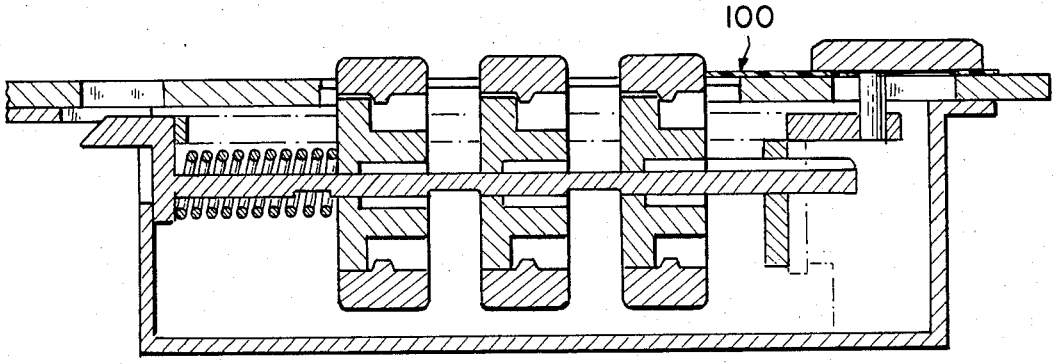
FIG. 8 is a cross-sectional view of the combination lock shown in FIG. 7.
Figure 9:
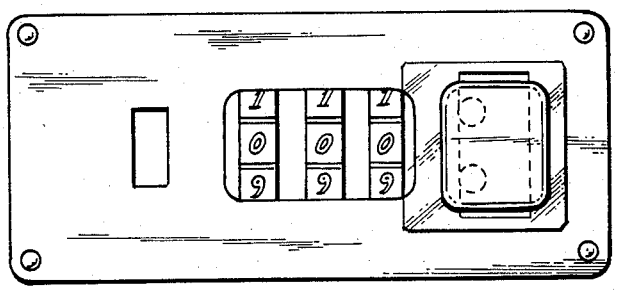
FIG. 9 is a top plan view of the invention as shown in FIG. 7.

As shown in FIGS. 7, 8, and 9, the guard member 100 of the present invention (sold under the trademark SCRAMBLE GUARD) is a flat locking member made of suitable plastic material or the like having an interior opening 102 for receiving the stem or stems 14 of the actuating button 12. Guard member 100 is seated under actuating button 12 and is seated on cover plate 17. Cover plate 17 includes a cutout 17*a* in alignment with opening 102. In this embodiment, guard member 100 completely surrounds the interior opening 102, and the interior opening 102 is of a size smaller than the outer periphery of said actuating button 12 in order to prevent the guard member 100 from being slipped over and removed from under said actuating button 12. Thus, this arrangement avoids the prior art problems wherein the guard member was easily removed from the lock by slipping it over the actuating button. It should also be understood that the present invention includes within its scope an embodiment in which the guard member includes a slit or the like formed in one of its sides, so that the guard member substantially surrounds interior opening 102, instead of completely enclosing it.

Guard member 100 includes four legs 104, 106, 108, and 110. In this embodiment, leg 104 is referred to as the blocking leg and is disposed between the actuating button 12 and combination wheel 26. In addition, the width of blocking leg 104 is approximately equal to or slightly less than the distance between the stem 14 and the side of combination dial 26. In this manner, blocking leg 104 prevents the actuating button from being moved towards the combination wheel 26, which prevents tempering with the lock and prevents setting or resetting of the combination until the guard member 100 is removed.

Blocking leg 104 includes a first abutment surface or edge 104*a* for engaging the stem or stems 14 of the actuating button 12 and a second abutment surface or edge 104*b* for engaging the side of the combination wheel 26. In this manner, guard member 100 prevents actuating button 12 from being moved to set the combination.

When it is desired to remove guard member 100 to set the combination, it may be cut or bent in order to facilitate removal.

In accordance with the present invention, it should be understood that guard member 100 is made of plastic but can be made of any other suitable material for accomplishing the purpose intended. In addition, although guard member 100 has been shown as having a rectangular outer configuration and a rectangular interior opening 102, it should be understood that this is only the preferred embodiment. More particularly, the outer periphery of guard member 100 can be of any other suitable shape, such as square, oval, or circular. In addition, the interior opening 102 can also be of any other suitable shape to accomplish the purpose intended, including, but not limited to, circular or oval. It should also be understood that the thickness of guard member 100 has to be less than the space between the cover plate 17 and the actuating button 12 so that guard member 100 can fit under actuating button 12 to engage the actuating stem or stems 14.

Figure 10:
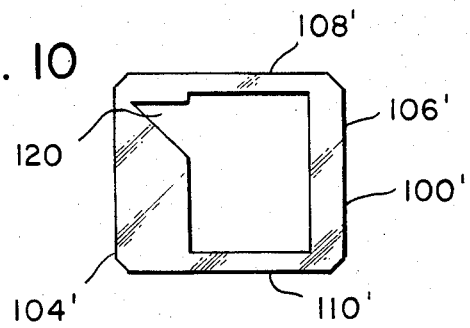
FIG. 10 is a top plan view of a modified guard member in accordance wih the present invention.

The present invention also encompasses another embodiment shown in FIG. 10 and designated as 100' having all the same reference numerals and parts as shown in FIG. 7. However, guard member 100' has been modified to include a notch 120 formed in blocking leg 104' which operates to facilitate removal of the guard member from the actuating button 12'. More particularly, notch 120 allows plastic guard member 100' to be easily bent or deformed, so that it can be more easily removed from actuating button 12 without having to cut the guard member, as in the case of guard member 100. Alternatively, if guard member 100' is cut for removal, it is easier to do having notch 120.

It should also be understood that although notch 120 has been shown formed in blocking leg 104 and having a triangular configuration, notch 120 can be of any suitable configuration to allow the guard member to be more easily deformed. In addition, notch 120 can be formed in any of the legs 104', 106', 108', and 110' of guard member 100'.

Figure 11:
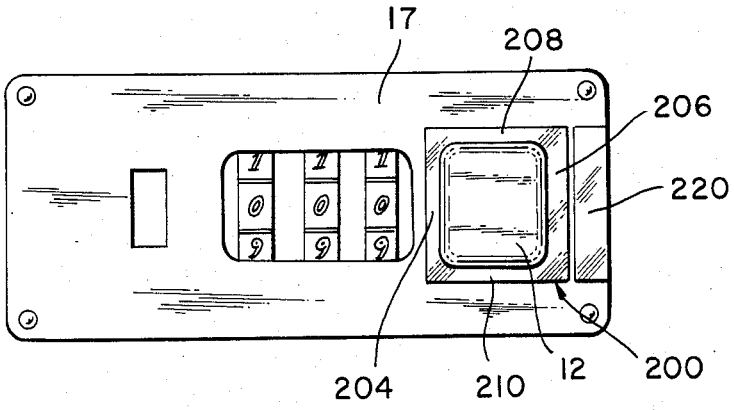
FIG. 11 is a top plan view of an embodiment employing an abutment on the cover plate.

The present invention also encompasses another embodiment of a guard member shown in FIG. 11 for use on combination locks, wherein the reset mechanism functions by moving the actuating button 12 away from the dials. The guard member is designated with reference numeral 200 having an interior opening 202 and legs 204, 206, 208, and 210. In this embodiment, leg 206 is referred to as the blocking leg and is disposed between the actuating button 12 and an abutment 220. Abutment 220 is an upstanding member formed on the edge of cover plate 17. The width of blocking leg 206 is approximately equal to or slightly less than the distance between stem 14 and abuttment 220. In this manner, blocking leg 206 and abutment 220 cooperate to prevent actuating button 12 from being moved towards abutment 220, which prevents setting of the combination lock until guard member 200 is removed.

Advantageously, as a result of the present invention, there has been provided an improved guard member which is extremely effective in preventing tampering with the combination, is economical to manufacture, and easy to install. That is, in the present invention, because of the size of openings 102 and 202, guard members 100, 100' and 200 must be installed on the combination lock at the time it is manufactured. Moreover, not only is the guard member effective in preventing tampering, but it is also easily removed by cutting the guard member or deforming it so that it may be removed.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A guard member for use on a combination lock for preventing the combination wheels from being reset, wherein the combination lock includes an actuating button, a stem connected to said button, and an inner lock mechanism for resetting said combination lock connected to said stem, comprising:

a locking member having an interior opening for receiving the stem connecting said actuating button to said inner lock mechanism and for being seated under said actuating button and on the cover plate of the lock;

said locking member substantially surrounding said interior opening, and said interior opening being of a size smaller than said actuating button to prevent said locking member from being removed from said actuating button without deformation; and said locking member having a blocking leg disposed between said actuating button and said combination wheels and being of a size to prevent said actuating button from being moved toward said combination wheels to set or reset the combination.

2. A guard member in accordance with claim 1, wherein said blocking leg includes a first abutment on the inner periphery of said locking member for engaging the stem under said actuating button and a second abutment on the outer periphery of said locking member for engaging said combination wheel.

3. A guard member in accordance with claim 2, wherein said first and second abutments each comprise straight edges.

4. A guard member in accordance with claim 1, wherein said interior opening is rectangular in shape.

5. A guard member in accordance with claim 1, wherein the outer periphery of said locking member is rectangular in shape.

6. A guard member in accordance with claim 1, wherein said locking member has a cutout formed in it for facilitating removal of said guard member from said actuating button.

7. A guard member in accordance with claim 6, wherein said cutout is formed on the inner edge of said blocking leg.

8. A guard member in accordance with claim 1, wherein said locking member has a flat configuration.

9. A guard member for use on a combination lock for preventing the combination wheels from being reset, wherein the combination lock includes an actuating button, a stem connected to said button, a cover plate having a cutout through which said stem extends, and an inner lock mechanism for resetting said combination lock connected to said stem, comprising:

a locking member having an interior opening for receiving the stem connecting said actuating button to said inner lock mechanism and for being seated under said actuating button and on the cover plate of the lock;

said locking member substantially surrounding said interior opening, and said interior opening being of a size smaller than said actuating button to prevent said locking member from being removed from said actuating button without deformation;

an abutment disposed on said cover plate on the side of said cutout remote from said combination wheels; and said locking member having a blocking leg disposed between said actuating button and said abutment and being of a size to prevent said actuating button from being moved away from said combination wheels to set or reset the combination.

* * * * *

UNITED STATES PATENT AND TRADEMARK OFFICE

CERTIFICATE OF CORRECTION

PATENT NO. : 4,735,067

DATED : April 5, 1988

INVENTOR(S) : Abraham I. Tawil

It is certified that error appears in the above-identified patent and that said Letters Patent is hereby corrected as shown below:

Column 2, line 44, change "3" to --2--.

Signed and Sealed this

Sixth Day of December, 1988

*Attest:*

DONALD J. QUIGG

*Attesting Officer*

*Commissioner of Patents and Trademarks*